US005244475A

United States Patent [19]

Lownds et al.

[11] Patent Number: 5,244,475

[45] Date of Patent: Sep. 14, 1993

[54] RHEOLOGY CONTROLLED EMULSION

[75] Inventors: C. Mick Lownds, Salt Lake City, Utah; Steven C. Grow, McGregor, Tex.

[73] Assignee: Mining Services International Corporation, Salt Lake City, Utah

[21] Appl. No.: 621,767

[22] Filed: Dec. 4, 1990

Related U.S. Application Data

[63] Continuation of Ser. No. 393,533, Aug. 11, 1989, abandoned.

[51] Int. Cl.[5] ..... B01J 13/00; C08F 2/32; C08F 36/06; C10L 7/02

[52] U.S. Cl. ..... 44/271; 44/272; 44/301; 149/108.8; 149/118; 252/309; 260/DIG. 45; 524/801; 525/332.5; 526/219.5; 526/932

[58] Field of Search ..... 252/309; 149/108.8, 149/118; 44/271, 272, 301; 260/DIG. 45; 524/801; 525/332.5; 526/219.5, 932

[56] References Cited

U.S. PATENT DOCUMENTS

| | | | |
|---|---|---|---|
| Re. 27,444 | 7/1972 | Will | 521/62 |
| 3,324,662 | 6/1967 | McLean | 61/35 |
| 3,324,663 | 6/1967 | McLean | 61/36 |
| 3,447,978 | 6/1969 | Bluhm | 149/2 |
| 3,786,116 | 2/1974 | Milkovich et al. | 260/885 |
| 3,832,423 | 8/1974 | Milkovich et al. | 260/878 |
| 3,914,216 | 10/1975 | Huskins | 540/506 |
| 4,077,931 | 3/1978 | Leitheiser et al. | 521/63 |
| 4,097,662 | 6/1978 | Huskins | 526/217 |
| 4,343,663 | 8/1982 | Breza et al. | 149/4 |
| 4,357,184 | 11/1982 | Binet et al. | 149/2 |
| 4,385,164 | 5/1983 | Sinclair et al. | 525/185 X |
| 4,391,659 | 7/1983 | Smith | 149/2 |
| 4,470,855 | 9/1984 | Bampfield | 149/2 |
| 4,473,418 | 9/1984 | Bampfield et al. | 149/2 |
| 4,496,405 | 2/1985 | Cechanski | 149/2 |
| 4,548,660 | 10/1985 | Ikeda et al. | 149/21 |
| 4,602,970 | 7/1970 | Stigasom | 149/108.8 |
| 4,736,683 | 4/1988 | Bachman et al. | 149/60 X |

*Primary Examiner*—Richard D. Lovering
*Attorney, Agent, or Firm*—Workman, Nydegger & Jensen

[57] ABSTRACT

An emulsion composition with a polymerizing and/or crosslinking agent and method for its use in improving the manufacturing, packaging, transporting, storage placement and blasting characteristics of explosives containing an emulsion. More specifically, compositions and methods directed to controlling the rheology of an emulsion or explosive containing an emulsion by polymerizing and/or crosslinking the continuous phase of the emulsion by employing hydroxy-terminated polybutadiene and polymerizing agents and/or maleic anhydride adducted polybutadiene and crosslinking agents, but without compromising the integrity of the explosive reaction.

Explosive materials comprised of a water-in-oil emulsion containing a continuous carbonaceous fuel phase at least partially polymerized and/or crosslinked.

6 Claims, No Drawings

RHEOLOGY CONTROLLED EMULSION

This is a continuation patent application under 37 C.F.R. § 1.60, of prior application Ser. No. 07/393,533, filed on Aug. 11, 1989 by C. Mick Lownds and Steven C. Grow entitled RHEOLOGY CONTROLLED EMULSION (now abandoned).

BACKGROUND

1. The Field of the Invention

The present invention relates to methods and compositions for controlling the rheology of emulsion compounds and explosives containing an emulsion. More particularly, the present invention is related to an emulsion with a polymerizing and/or crosslinking agent which permits the preselection of a desired rheology of the subject emulsion compound.

2. Background of the Invention

Explosive compositions are frequently used in construction and mining related enterprises. The physical characteristics of explosive compounds vary with the intended use. In some circumstances it is desirable to utilize an explosive composition whose viscosity is so low that the explosive composition may be pumped into its intended site. On the other hand, it may be desirable to utilize an explosive composition which alone is rigid enough to withstand the weight of stacking in storage or as packaged material, when stacked vertically in a borehole.

In the last few decades, developments in mining explosive technology have produced explosives far different from nitroglycerine-based explosives used in the past. Explosives are now made from components which are much less expensive and are less dangerous to prepare, transport and use. These developments have resulted in slurries and explosives containing an emulsion.

The development of slurries has resulted in the use of thickening agents such as water-soluble gums, especially guar gum, allowing control of the rheology of continuous phase of the slurry and, hence, the slurry matrix. Slurries continue, however, to be plagued with crystallization of the discontinuous phase. Slurries are prone to crystallization at low temperatures. This compromises the intimacy of the mixing of the oxidizers and fuels and results in a loss of sensitivity. This problem is particularly acute in small diameter applications. Loss of sensitivity is overcome by employing expensive ingredients such as paint grade aluminum, TNT, monoethanolamine nitrate, hexamethylenetetramine nitrate, ethylene glycol mononitrate, and the like. What is needed is an explosive composition whose sensitivity is not compromised by crystallization, but which retains the versatility of rheology control exhibited by slurries or water-gel explosives.

Explosives containing an emulsion are now well-known and overcome many of the problems encountered with previous explosive formulations. The discovery of water-in-oil emulsions has resulted in pumpable fluid-like explosives containing an emulsion which prove superior to slurries for many uses. Generally, emulsions include two separate phases. These phases comprise a discontinuous internal phase of an aqueous solution of oxidizers and a continuous external phase of a carbonaceous fuel, such as oils and waxes, and an emulsifier. The typical explosive containing an emulsion also contains sensitizers in order to render them detonable. One of the favorable features of explosives containing an emulsion is the fact that the surface area of contact between the fuel phase and the oxidizing phase is increased such that the fuel phase and the oxidizing phase are more intimately interspersed and, hence, more sensitive and faster reacting upon detonation.

Emulsions have provided some solutions to problems of water resistance, separation of components, and loss of detonability at low temperatures. Explosives containing water-in-oil emulsions also have other advantages. They are safer because they are less sensitive to mechanical shock, and less expensive because the principal component ingredients of water, oil, ammonium nitrate, emulsifying agents, and sensitizers are available at relatively lower cost.

When emulsions are properly prepared, the interspersed oxidizer droplets of the oxidizing phase are so small that they are able to be supercooled. As a result, a highly concentrated aqueous solution with a crystallization temperature well above room temperature can be obtained and incorporated into the discontinuous oxidizing phase. Such an aqueous solution will not experience crystallization even upon cooling to a temperature well below the crystallization temperature. This preserves the intimacy of the mixing and the desired sensitivity. However, currently available emulsions have limited shelf life because of the tendency of the aqueous phase to crystallize and for such crystals, by rupturing the barriers between droplets, to grow. The emulsion then loses sensitivity.

The rheology of currently available explosives containing an emulsion is dependent largely upon the physical consistency of the continuous fuel phase and on the volume ratio of oxidizer to fuel phases. Rheology control manipulates the phase volume ratio of the oxidizer solution of the discontinuous phase to the continuous fuel phase, and/or selectively varies the size of the droplets of the oxidizer solution, and/or selectively varies the viscosity of the continuous fuel phase. The choice of phase volume ratio dictates the rheology of the emulsions and explosives containing an emulsion. For example, if the ratio of oxidizer solution to fuel is large the resulting emulsions are stiff. Similarly, if the solution droplets are small the resulting emulsions are stiff. Furthermore, if the fuel phase comprises a thick oil the resulting emulsions are highly viscous, or if the fuel phase comprises a wax the resulting emulsions have a high degree of plasticity.

The ability to control the rheology of the emulsion or explosive containing an emulsion becomes very apparent when considering the manufacturing of explosives containing an emulsion. As stated, oils and waxes are selectively chosen to obtain the desired rheology of an emulsion or explosive containing an emulsion. If, for example, it is desirable to cartridge the explosive containing an emulsion, or to assure that air bubbles or other discontinuous phases are held in place, the oils or waxes must be fluid at the temperature of manufacture in order to form and refine, and then pour or pump the emulsion. As a result, the rheology of the final composition is then dependent on temperature. Even emulsions and explosives containing an emulsion containing waxes which are relatively stiff at the lower temperatures of use are relatively and often undesirably soft at higher temperatures of use. Change in the rheology with temperature is contrary to the constant environment needed to effectively disperse or maintain in dispersion a discontinuous oxidizing phase or sensitizing agent. In other words, temperature changes work not only a change in the rigidity of the composition itself, but also detrimentally influence the ability of the emulsion or explosive containing an emulsion to hold or lock the discontinuous oxidizing phase and/or sensitizers in place.

An explosive containing an emulsion whose composition permitted the user to select the rheology of the ultimate explosive containing an emulsion, much as is possible with water-gel explosives, would be much more desirable. Such a composition would provide an explosive containing an emulsion which is capable of effectively stabilizing the continuous and discontinuous phases over a wide range of temperatures such that the explosive containing an emulsion would be less sensitive to temperature changes. Similarly, it would be an advancement in the art if the rheology of a given emulsion or explosive containing an emulsion would permit the control of other significant characteristics of the composition, such as waterproofing, surface adhesion, and wetness. Indeed, what is needed is a polymerizing agent or crosslinker which permits the user to select the desired rheology.

Therefore, it would be a further advantage and improvement in the art if the rheology of an emulsion or explosive containing an emulsion could be controlled to produce an emulsion or explosive containing an emulsion which is more stable, i.e., less prone to crystallization of the oxidizer salts in the solution of the discontinuous phase and to subsequent growth of the crystals.

Such an emulsion and explosive containing an emulsion are disclosed and claimed below.

BRIEF SUMMARY AND OBJECTS OF THE INVENTION

The present invention relates to emulsion compositions with a polymerizing and/or crosslinking agent and methods for use in improving the manufacturing, packaging, transporting, storage and placement of emulsions and explosives containing an emulsion. More particularly, the present invention is directed to controlling the rheology of an emulsion or explosive containing an emulsion by polymerizing and/or crosslinking the continuous phase of the emulsion. The present invention provides compositions and methods of polymerizing and/or crosslinking emulsion compositions which result in an emulsion or explosive containing an emulsion whose rheology may be controllably selected, without compromising the integrity of the explosive reaction.

The present invention is directed to an emulsion comprising a fuel phase, an oxidizing phase, an emulsifier, a selected amount of polymerizable and/or crosslinkable material, and a coreactant to effect polymerization or crosslinking reaction in situ.

The present invention is also directed to an explosive containing an emulsion comprising a fuel phase, an oxidizing phase, an emulsifier, a selected amount of polymerizable and/or crosslinkable material, a coreactant to effect polymerization or crosslinking reaction in situ, a sensitizer, and optional additional fuels or oxidizers.

The composition of the present invention comprises a water-in-oil emulsion containing a continuous external carbonaceous fuel phase. The fuel phase contains a polymerizable and/or crosslinkable polymer which is polymerized or crosslinked. Depending upon the chemistry of the polymer or crosslinker, the amount used, temperature and pH, the polymerizing and crosslinking reaction adjusts the rheology of the selected emulsion to the desired rheology and stabilizes the emulsion composition. As a result, the coalescence, crystallization, agglomeration, or migration of the discontinuous oxidizing phase of the emulsion and/or sensitizing agents of the explosive containing an emulsion is reduced, and the final rheology of the emulsion or explosive containing an emulsion is optimal for its intended use.

The rheology control mechanism of the present invention is one that is not only influenced by the chemistry of the polymer or crosslinker, the amount used, temperature and pH, but also by the period of time over which the polymerization and/or crosslinking reaction occurs. That is, the rheology change of the continuous phase of the emulsion may be controlled over time as desired.

Included within the fuel phase of the present invention is a crosslinkable and/or polymerizable carbonaceous oil and/or wax. In one preferred embodiment, the polymerizable material is hydroxy-terminated polybutadiene (HTPB). In many cases the HTPB can be substituted by a butadiene-styrene copolymer, a polymer with hydroxy functional groups, or other carbonaceous, polymerizable materials with, for example, epoxy functional groups.

HTPB and similar polymerizable carbonaceous materials may be polymerized by reaction with multi-functional isocyanates. In most cases, a suitable polymerizing isocyanate may be chosen from the group of high molecular weight, low vapor pressure isocyanates. A preferred isocyanate is Isonate® 143L In the case of HTPB and Isonate® 143L, they act as coreactants to effect the polymerization of some of the continuous phase of the emulsion.

The present invention is also directed to a crosslinkable carbonaceous material used in conjunction with or mutually exclusive of the polymerizable carbonaceous material. A preferred crosslinkable material is maleic anhydride adducted polybutadiene (131 MA). Other suitable redundant materials may also be used. The crosslinkable material is crosslinked employing a suitable crosslinking catalyst or coreactant. In the case of 131 MA, a basic reagent, or a multifunctional hydroxy group is an effective crosslinker. Examples of suitable crosslinkers include ammonia, ethylene glycol, polyethylene glycol, tri- and monoethanolamine, and other alkaline materials. The presently preferred crosslinker is triethanolamine. Practice of the invention has revealed that other crosslinker coreactants aid the crosslinking process. Suitable crosslinking coreactants include metal organic compositions, and poly-hydroxy compounds or polyols.

The internal, discontinuous oxidizing phase of the emulsion comprises an aqueous solution of oxygen-containing salts. Suitable salts include ammonium nitrate, calcium nitrate, sodium nitrate, or perchlorate. The salts are dispersed in the continuous phase so as to provide intimate contact with the continuous fuel phase.

The emulsifier required by the present invention comprises any effective water-in-oil emulsifier. Suitable water-in-oil emulsifiers include known compounds such as sorbitan mono-oleate, sorbitan tristearate, sorbitan sesquiolette, polyisobutylene sulphonic acid, and the like.

An explosive containing an emulsion may be compounded by combining an emulsion as discussed above as a continuous phase, with undissolved, solid oxidizers such as ammonium nitrate or other nitrates or perchlorates, and solid fuels such as coal dust, hydrocarbon. fuels or aluminum as discontinuous phases. A preferred embodiment of explosives containing an emulsion phase and a second reactive phase is the so-called heavy ANFO explosive which comprise an emulsion combined with porous ammonium nitrate or with ANFO.

Sensitizers are typically used in conjunction with explosives containing an emulsion. Sensitizers and density-control agents used in conjunction with the present invention may include for example, porous prill ammonium nitrate or ANFO, microballoons or microspheres, polystyrene beads, self explosives such as TNT, gassing bubbles from nitrite or peroxide solutions, perlite, emulsified gassing agents, and the like. The amount of solid or chemical density-control agents is chosen to give the emulsion or explosive containing an emulsion a void volume in the range from about 4% to about 80% of the final compound. The amount of void space required in the explosive containing an emulsion depends upon the required bulk energy of the explosive and the desired sensitivity.

Oils of low and high viscosity, and various kinds of waxes, e.g., paraffin wax or microcrystalline wax, may be employed in conjunction with the polymerizable or crosslinkable material to add to the control of the rheology of the emulsion or explosive containing an emulsion after polymerization or crosslinking has been effected.

It is, therefore, the object of the present invention to provide compositions and methods for increasing the effectiveness of explosive compositions containing an emulsion phase.

It is a related object of the present invention to provide compositions and methods for controlling the rheology of an emulsion or explosive containing an emulsion by crosslinking and/or polymerizing the continuous phase of the emulsion.

It is a related object of the present invention to provide compositions and methods for controlling the rheology of an emulsion or explosive containing an emulsion by providing selective control of crosslinking and/or polymerizing within the continuous phase of the emulsion at room temperature.

It is yet another objective of the present invention to provide compositions and methods for inhibiting crystallization, coalescence, agglomeration, migration, and the like of discontinuous oxidizing, sensitizing, or density-control phases, and the like.

It is still further an objective of the present invention to provide compositions and methods for providing an emulsion or explosive containing an emulsion which is less temperature sensitive.

These and other objects and advantages of the present invention will become apparent upon reference to the following description of the invention and the appended claims.

DETAILED DESCRIPTION OF THE PREFERRED EMBODIMENTS

The present invention is related to compositions and methods for preparing an emulsion or explosive containing an emulsion which are selectively and controllably crosslinked and/or polymerized in order to control the rheology of the emulsion composition or emulsion phase of the explosive containing an emulsion. By employing the present invention, particular physical properties of the emulsion may be chosen for optimizing the intended manufacturing, packaging, transporting, storage, and use of the emulsion or explosive containing an emulsion.

The present invention resides in a crosslinkable and/or polymerizable emulsion or emulsion phase of an explosive containing an emulsion. The emulsion comprises principally a water-in-oil emulsion. The emulsion has a crosslinkable and/or polymerizable component in the external continuous fuel phase. It also has an internal discontinuous oxidizing phase. The explosive containing an emulsion comprises an emulsion phase and a sensitizer, and may also contain additional fuels, additional solid oxidizers, and any other necessary or desirable components to control energy and/or density of the final explosive product.

Traditionally, in prior art compositions, the external carbonaceous fuel phase of an emulsion comprises fuel oils, refined or purified hydrocarbons, waxes, halogenated hydrocarbons, nitrated hydrocarbons or a mixture thereof. However, when the carbonaceous fuel phase comprises a liquid which is flowable at, or slightly above, ambient temperatures the explosive containing an emulsion is not generally suitable for packaging using conventional explosive packaging or cartridging methods. Such explosives may similarly be unsuitable for use in boreholes with fissures and cracks because flowable explosive compositions escape the borehole.

A. Rheology Control Via Polymerization

1. In the emulsion

Conventional emulsions attempt to provide a continuous fuel phase which suitably inhibits the crystallization, coalescence, agglomeration and migration of the discontinuous phase by including polymers in the continuous phase or by choosing a particular emulsifier. Conventional emulsions have not, however, sought to control the rheology of the continuous phase by polymerizing the continuous phase in situ in a controlled, predictable, and reliable reaction. The present invention provides a continuous fuel phase that includes high molecular weight hydrocarbon species which can be and are at least partially polymerized and/or crosslinked in order to effect a change in the rheology of the emulsion, and, therefore, of the explosive containing an emulsion, as a whole.

An embodiment of the present invention employs, for example, a polymerizable organic material with hydroxy or epoxy functional groups. Particularly, an embodiment of the present invention comprises polybutadiene as the polymerizable organic fuel. More particularly, the preferred embodiment of the present invention employs hydroxy-terminated polybutadiene (HTPB) as the polymerizable fuel.

HTPB is characterized by the presence of a polymer of from about at least fifty (50) repeating monomer units with at least two functional units capable of bonding with other molecules. Such a material results in long, flexible polymer chains whose mass is pliable and can withstand moderate stress and strain without tearing or crumbling. The character of the certain polymerized fuel materials provides the continuous phase of the emulsion with advantageous preselected elastic properties. Suitable substitutes for HTPB include carboxy-terminated polybutadiene, maleic anhydride-terminated polybutadiene, epoxy-terminated polybutadiene, and similar substances. In practice, suitable results are obtained when HTPB is present in amounts ranging up to approximately 5.9%. Better results are obtained when HTPB exists in the emulsion ranging from about 0.75% to about 3.0%. In one preferred embodiment, HTPB is present in concentrations ranging from about 1.0% to about 2.0%.

The polymerizable organic fuel of the present invention is polymerized with the assistance of isocyanate compounds. Because of the hazards associated with the vapors of low molecular weight isocyanates, high molecular weight, low vapor pressure isocyanates are preferred. More particularly, Isonate® 143L has been proven to give superior results. Satisfactory results using Isonate® 143 L have been obtained when present in an amount ranging up to about 0.6%. More suitable results are obtained when Isonate® 143 L is present ranging from about 0.075% to about 0.3%. Preferably, Isonate® 143 L is present in an amount ranging from about 0.1% to about 0.2%.

2. In the explosive containing an emulsion

An explosive containing an emulsion comprises an emulsion phase, energizing/sensitizing agents, and if desired, additional fuels and oxidizers. In other words, the multiphase emulsion discussed above becomes one phase of the explosive compound. In the same manner that the polymerization of the continuous fuel phase of the emulsion chemically changes the rheology of the emulsion, controlling the rheology of the emulsion phase of the explosive containing an emulsion changes the rheology of the explosive containing the emulsion. In this way, the benefits of controlling the rheology of the emulsion can be transferred over to controlling the rheology of the explosive containing the emulsion. Control of the rheology of the explosive containing the emulsion is of great advantage in the manufacturing, packaging, transporting, storage and placement in use of the explosive composition.

Mixing the emulsion with other phases of the explosive, and packaging the explosive, may now be accomplished at or near room temperature. The emulsion can be formulated so that the explosive matrix is more stable during transportation. The temperature of storage is no longer necessarily detrimental to the integrity of the explosive composition. The intended use or placement of the explosive composition may be optimized by selecting a rheology most conducive to the intended use or placement. For these reasons, and other reasons which become apparent during the practice of the present invention, the rheology control of the present invention is a significant advance in the art.

B. Rheology Control Via Crosslinking

1. In the emulsion

Some known emulsion systems contemplate the use of additives to thicken the composition of the emulsion. Known additives include agents such as natural waxes, water-soluble gums such as guar gum, and synthetic polymers or waxes. Many of the conventional uses of thickening additives emphasize physical rather than chemical rheology changes.

The present invention provides a change in rheology by means of a chemical reaction within the continuous fuel phase of the water-in-oil emulsion. The chemical reaction adjusts the rheology of the emulsion by chemically crosslinking at least a portion of the fuel phase. The crosslinker operates to crosswise connect parallel and/or adjacent chains of polymerized fuel. The crosslinking may continue until the polymerized fuel phase is bound by a matrix mass of crosslinked polymers. The result of the crosslinking is a relatively fixed continuous phase of the emulsion. The character of certain crosslinked materials provides the continuous phase of the emulsion with advantageous preselected rigidity properties. For example, the preselected or desired rigidity may be a rubbery state, or a stiff, solid state. The fixed nature of the continuous phase operates to lock or hold the discontinuous phase in its location. This aids to inhibit the crystallization, coalescence, agglomeration and migration of oxidizing droplets of the discontinuous phase which plague conventional water-in-oil emulsions.

In the present invention, it has been determined that 131 maleic anhydride adducted polybutadiene (131 MA) is an effective crosslinkable polymer. The reactive sites of the 131 MA provide bonding sites at which the crosslinker operates to bind the polymer chains together. Other suitably crosslinkable polymers include compounds having difunctional moieties which may have active bonding sites as are found in anhydride or oxirane groups, nitrogen based groups such as isocyanates, amines, imides, or amides, or carbonyl or hydroxyl groups which in conjunction with a catalyst or accelerator bond with the functional groups of the polymer.

Suitable examples of crosslinkers include ammonia, ethylene glycol, polyethylene glycol, tri- and monoethanolamine, and other alkaline materials. Satisfactory results using monoethanolamine have been obtained when present in an amount ranging up to about 0.3%. More suitable results are obtained when monoethanolamine is present ranging from about 0.05% to about 0.3%. Preferably, monoethanolamine is present in an amount ranging from about 0.1% to about 0.3%.

Acceptable results using triethanolamine are obtained when triethanolamine is present in a quantity up to about 0.3% of the emulsion as a whole. More favorable results are obtained when triethanolamine is present in an amount from about 0.1% to about 0.3%. Preferred results occur when triethanolamine is present in quantities from about 0.15% to about 0.2%.

The extent of the crosslinking can be controlled by the selection of the crosslinkable polymer, the crosslinker, the choice of crosslinking coreactant, the amount of crosslinker used, the functional groups added to the polymerized fuel, and the rate of reaction of the crosslinking. The application of the present invention vis-a-vis crosslinkers has resulted in superior results in controllably altering the rheology of the continuous phase of the emulsion, and as a result, inhibiting crystallization, coalescence, agglomeration and migration of the discontinuous phase or phases of dispersed oxidizing components.

The rate of reaction of the crosslinker depends upon the chemistry of the crosslinker, the temperature at which the reaction occurs, and the pH of the environment in which the reaction occurs. The crosslinking process may be enhanced by coreactants including metal organic compositions, and polyhydric alcohols such as polyethylene glycol.

2. In the explosive containing an emulsion

For similar reasons as discussed above relative to polymerization, controlling the rheology of the emulsion by crosslinking may be transferred over to controlling the rheology of an explosive by incorporating the emulsion into the explosive composition. If the rheology controlled emulsion is a phase of the explosive composition, then as a result, the rheology of the explosive composition will also be controllable. Crosslinking the continuous phase of an emulsion contained in an explosive operates to control the rheology of the explosive compound as well.

C. Rheology Control Via Polymerization And/Or Crosslinking

One example of an embodiment of the present invention is employing HTPB and 131 MA mutually exclusive of each other. Satisfactory results have been obtained. Another example of an embodiment of the present invention is employing both polymerization and crosslinking. By combining rheology control via polymerization and crosslinking, the character of the resulting composition can provide the continuous phase of the emulsion with a combination of the preselected elastic and rigidity properties optimal for the intended use. An example of a combination use is when one of the fuels of the continuous phase is a butadiene homopolymer adducted with maleic anhydride. Similarly, favorable results are obtained when a butadiene-styrene copolymer, adducted with maleic anhydride, is used as one of the fuels of the continuous phase. Satisfactory results have been obtained when the polymerization of the fuel polymer of the continuous fuel phase is achieved by allowing the 131 MA to be polymerized with the HTPB exclusive of any polymerization enhancer or component, or crosslink reaction.

D. Oxidizing, Density-Control, And Sensitizing Agents

1. In the emulsion

Because oxygen balancing is vital for an optimal detonation of explosives, the availability of the oxidizing agent throughout the explosive composition to complete the reaction is of paramount importance. A crucial part of the oxidizing agent for detonation of an explosive containing an emulsion is provided by the discontinuous oxidizing phase of the emulsion. If the oxidizing droplets or particles of the discontinuous phase of the emulsion crystallize, coalesce, agglomerate or migrate, the intended dispersion effect of the oxidizers is obviously diminished.

Many oxidizing agents and phases are used in conventional emulsions. The preferable forms of oxidizing agent employed in the present invention include aqueous forms of ammonium nitrate, calcium nitrate, or sodium nitrate, or a mixture thereof.

The present invention also contemplates the use of dry ammonium nitrate-fuel oil prills (ANFO) in conjunction with the oxidizing agents hereinabove discussed.

2. In the explosive containing an emulsion

Similarly, homogeneous dispersion of density-control and sensitizing agents is vital for an optimal detonation of explosives. Just as dispersion of oxidizing agents is vital to optimal detonation, the dispersion of density-control and sensitizing agents throughout the explosive composition reaction is also of paramount importance. If dispersed density-control and sensitizing agents of the explosive composition crystallize, coalesce, agglomerate or migrate, the intended dispersion effect is defeated and the air-gap sensitivity and detonation velocity of the explosive composition are diminished.

Density-control and sensitivity components are included in an emulsion to make the emulsion more or less sensitive to shock initiation and to assure that the velocity of detonation through the emulsion compound is at a suitable and constant rate. Density-control agents include substances from the group including solid density reducing agents such as expanded polystyrene beads, perlite, microspheres and microballoons.

Increased sensitivity can be achieved by using injected air or gas bubbles, and air or gas bubbles generated in situ from peroxide, nitrite, or carbonate solutions, emulsified gassing agents, and similar gas-producing reactions which do not otherwise compromise the explosive nature of the explosive containing an emulsion. Sensitivity is also increased by the inclusion of self-explosives such as, for example, TNT, PETN, RDX, and the like.

E. Emulsifiers

Without the presence of an emulsifier, the mixed phases of the compositions may tend to separate to form a layered or regional mixture which has little utility as an emulsion.

Suitable emulsifiers for water-in-oil emulsions comprise an amphiphatic compound. The amphiphatic compound is one with at least two or more segments, one of which is only soluble in an oil phase and the other being only soluble in an aqueous phase. In other words, a preferred emulsifier comprises an organic emulsifier having a hydrophilic portion and a lipophilic portion, and exhibiting a high solubility in hydrocarbons and a high tolerance to salt solutions. In the case of the present invention, the emulsifier can be selected from the group of known water-in-oil emulsifiers. Examples of suitable emulsifiers include, but are not limited to, sorbitan mono-oleate, sorbitan tristearate, sorbitan sesquioleate, and glycerides of fat-forming fatty acids, or a mixture thereof.

The effective combination of the above-discussed components of the emulsion of the present invention results in an emulsion or explosive containing an emulsion whose rheology can be controlled to meet the needs and demands of the user. This is particularly evident during the course of the manufacturing, packaging, transporting, storage, and the ultimate placement of the explosive, where the rheology of the emulsion composition plays such an important role. For example, during the manufacture of an emulsion compound, it is vital to homogeneously disperse the discontinuous oxidizing phase in the continuous fuel phase. This is most easily accomplished when the continuous phase or phases have low viscosity such that the oxidizing phase can be thoroughly agitated and blended into the continuous fuel phase. If the rheology of the continuous phase is too rigid, the task of agitating and blending is made less efficient and effective. However, once the manufacturing stage has progressed to a point at which the discontinuous phase is homogeneously dispersed, it is typically desirable to have the discontinuous phase remain dispersed in the continuous phase without the detrimental effects of crystallization, coalescence, agglomeration or migration of the discontinuous phase. The present invention permits the manufacturer/producer to lock the dispersed, discontinuous phase of the emulsion or other phases of the explosive containing an emulsion in place by employing the polymerizing and/or crosslinking reactions of the present invention. These reactions can be accomplished at the high manufacturing temperature of the emulsion or at ambient temperature after the emulsion phase of the explosive composition has been allowed to cool. "Locking the dispersed, discontinuous phase" is meant to describe the effect of causing a change in the rheology of the continuous phase such that the crystallization, coalescence, agglomeration, or migration of the discontinuous phase is inhibited by a chemical reaction which structurally alters the host continuous phase.

Similarly, during packaging, it is very difficult to cause a sticky, highly viscous emulsion to flow into and fill a cartridge or package. It is most desirable that at the time of packaging the emulsion be readily pumpable and formable to the intended package without the inconsistencies of void and air pockets and without the need to maintain the emulsion at unwanted higher temperatures. As a result of use of the present invention, high temperature cartridging can be avoided because the chemical reaction may occur at or below the manufacturing temperature. Likewise, the ready transporting, storage, and handling of an emulsion is often dependent upon the rheology and temperature of the emulsion.

Furthermore, the ultimate and proper placement of the explosive at the intended site is vital to the performance of the explosive. If the intended situs of the detonation is in a vertically upward borehole in an underground mine, in a vertically downward borehole in an open pit mine, in a horizontal borehole on a coal or tunnel face, or in any shape of borehole at any angle in between, the ability of the laborer to effectively load, prime, and stem the borehole is directly related to the handling characteristics of the explosive as dictated by the rheology of the explosive composition. The rheology of the emulsion or explosive containing an emulsion is, therefore, critical.

The compositions and methods of the present invention provide for an emulsion whose physical characteristics such as surface adhesion, water resistance, viscosity and surface moisture may also be regulated as desired by the user. Because these physical characteristics are closely related to rheology, such physical characteristics may also be selected in accordance with the optimum use and performance of the emulsion. For example, in some circumstances it is desired to have an emulsion which has a greasy consistency. In another situation, a nongreasy, yet sticky emulsion may be optimal. In another situation, a thin syrupy emulsion may be desired. In yet another situation, a rigid emulsion may be advantageous. Similarly, any phase state in-between may be desirous ultimately or at some stage of the life of the emulsion.

The mechanism for polymerizing or crosslinking the continuous phase of the emulsion of the present invention to control the rheology of the emulsion varies. In some cases, polymerization of the continuous phase is sufficient to attain the desired rheology. In other cases crosslinking is required to stabilize the emulsion phase(s). Polymerizing and/or crosslinking the continuous phase of the emulsion permits one to control the rheology of the emulsion.

Polymerizing or crosslinking the continuous phase of the emulsion provides an emulsion whose rheology may be chosen corresponding to the desired and intended manufacturing, packaging, transporting, handling, storage, use and the like. The range of the rheology is determined by controlling the period of time over which the polymerization takes place or by choosing the appropriate crosslinker which will provide the desired crosslink of the continuous phase of the emulsion.

Crystallization, coalescence, agglomeration and migration of dispersed particles are functions of the affinity of the dispersed element to the interfacing substance, of gravity, of density, and of the rheology of the continuous phase. Maintaining the dispersed nature of an oxidizing agent is important to the most desirable performance of the emulsion vis-a-vis oxygen balancing of the blasting reaction. By polymerizing and/or crosslinking the continuous fuel phase, the discontinuous phases of the emulsion or explosive containing an emulsion are stabilized.

The ability to control the change of rheology of the present invention focuses on a chemical reaction which is less dependent on temperature than the rheology control of known emulsion and emulsion-containing compounds. In addition, once the desired rheology is attained by employing the present invention, the steady state of the rheology is also less affected by changes in ambient temperature than the steady state of currently available emulsion compounds. This is a result of the chemical bonding between the polymeric components of the emulsion. Conventional emulsions relied primarily upon the physical mixture of the substituent elements and any help that the emulsifier might provide in maintaining the steady state of the phase distinctions. The chemical reaction of the present invention operates to interconnect and bind together at least some of the monomers and polymers of the continuous phase in such a way that the discontinuous phases are locked or held in place as if they resided in interstitial space in a molecular structure. In this way, the discontinuous phases remain dispersed throughout the continuous phase, thereby maintaining the intimate contact between the fuel phase and oxidizing phase of the emulsion and promoting the detonability of the explosive containing an emulsion.

In addition to the selection of the rheology of the emulsion, the present invention is directed to the ability of the user of the present invention to select a range of rheology of the subject emulsion over a period of time, if desired, by controlling the rate of reaction of the polymerization or crosslinking. It is a well known fact that the rate of many chemical reactions can be controlled by factors such as concentration, temperature, pH, and the like. In the case of polymerizable or crosslinkable polymers, the ratio of functional groups on the polymer to the function groups on the crosslinker or polymerizer plays a significant role in the rate of reaction of the polymerization or crosslinking. The present invention permits the controlled variation in the rate of reaction of polymerization and crosslinking. In this case the extent of polymerization or crosslinking determines the rheology of the emulsion at any given time. If it is desired that the emulsion be fluid for a certain period of time and later set to a more rigid state, the extent and rate of polymerization and/or crosslinking is controlled by choosing the appropriate polymer and polymerization process and the corresponding crosslinking reaction.

EXAMPLES

The following examples are given to illustrate the general scope of the present invention, but these examples are not intended to limit the scope of the invention. Similarly, while the following examples represent a range of composition substituents of suitable emulsions and emulsion phases of explosives containing an emulsion, other ranges of composition substituents outside the ranges illustrated by the following examples also provide suitable emulsions and emulsion phases of explosives containing an emulsion.

The emulsions in the following examples were allowed to cool to room temperature before other ingredients were added. This practice was convenient in the laboratory, but does not imply that similar compositions could not be obtained by incorporating all ingredients into the final composition with the emulsion still at its elevated temperature of mixing.

In each example, the number of days of curing is quoted. This is the time at which the ultimate rheology was examined, and not the time taken for the crosslinking or polymerization reaction to become effective.

Example 1

An explosive containing a polymerized emulsion compound was prepared by mixing the following ingredients:

| Ingredients | Percentage |
|---|---|
| Ammonium Nitrate | 63.2 |
| Sodium Nitrate | 13.9 |
| Water | 12.0 |
| Emulsifier | 1.0 |
| Diesel Oil | 5.3 |
| HTPB | 1.5 |
| Isonate ® 143 L | 0.1 |
| Perlite | 3.0 |

The emulsion was made in the conventional manner by dissolving the ammonium nitrate and sodium nitrate in the water at an elevated temperature to form an aqueous phase. This aqueous phase was added with vigorous stirring to the polymerizable HTPB, to which had been added the emulsifier and fuel oil, until an emulsion was formed. The emulsion was allowed to cool to room temperature. Thereafter, the Perlite and the Isonate ® 143 L was added with stirring. The explosive containing the emulsion cured for one (1) day.

The thus formed explosive containing an emulsion resulted in a discontinuous oxidizing phase uniformly dispersed in a polymerized continuous fuel phase. The consistency of the explosive was non-tacky rubber.

Example 2

An explosive containing a polymerized emulsion compound was prepared by mixing the following ingredients:

| Ingredients | Percentage |
|---|---|
| Ammonium Nitrate | 24.4 |
| Calcium Nitrate | 18.3 |
| Water | 10.0 |
| Ammonium Nitrate Prills | 38.8 |
| Emulsifier | 0.9 |
| Diesel Oil | 5.5 |
| HTPB | 1.2 |
| Isonate ® 143 L | 0.2 |
| Polystyrene Beads | 0.7 |

The emulsion was made in the conventional manner by dissolving the ammonium nitrate and calcium nitrate in the water at an elevated temperature to form an aqueous phase. This aqueous phase was added with vigorous stirring to the polymerizable HTPB, to which had been added the emulsifier and fuel oil until an emulsion was formed. The emulsion was allowed to cool to room temperature. Thereafter, the Isonate ® 143 L, the ammonium nitrate prills and the polystyrene beads were added with stirring. The explosive containing the emulsion cured for over seven (7) days.

The thus formed emulsion resulted in a discontinuous oxidizing phase uniformly dispersed in a polymerized continuous fuel phase. The consistency of the thus formed explosive was firm and rubbery. The explosive remained detonable by 150 g of Pentolite in 3 inch diameter tubes for at least 4 weeks.

Example 3

An explosive containing a polymerized emulsion compound was prepared by mixing the following ingredients:

| Ingredients | Percentage |
|---|---|
| Ammonium Nitrate | 24.5 |
| Calcium Nitrate | 18.4 |
| Water | 10.0 |
| Ammonium Nitrate Prills | 39.0 |
| Emulsifier | 0.9 |
| Diesel Oil | 5.5 |
| HTPB | 1.2 |
| Isonate ® 143 L | 0.2 |
| Nitrite Solution | 0.3 |

The emulsion was made in the conventional manner by dissolving the ammonium nitrate and calcium nitrate in the water at an elevated temperature to form an aqueous phase. This aqueous phase was added by vigorous stirring to the polymerizable HTPB, to which had been added the emulsifier and fuel oil until an emulsion was formed. The emulsion was allowed to cool to room temperature. The ammonium nitrate prills were added with stirring. Thereafter, the Isonate ® 143 L was added with stirring. The explosive containing the emulsion cured for over fourteen (14) days.

The thus formed emulsion resulted in a discontinuous oxidizing phase uniformly dispersed in a polymerized continuous fuel phase. The consistency of the explosive was firm and rubbery.

Example 4

An explosive containing a crosslinked emulsion compound was prepared by mixing the following ingredients:

| Ingredients | Percentage |
|---|---|
| Ammonium Nitrate | 21.95 |
| Calcium Nitrate | 16.38 |
| Water | 8.76 |
| Ammonium Nitrate Prills | 44.90 |
| Emulsifier | 0.53 |
| Diesel Oil | 5.77 |
| 131 MA | 1.09 |
| Triethanolamine | 0.12 |
| Polystyrene Beads | 0.50 |

The emulsion was made in the conventional manner by dissolving the ammonium nitrate and calcium nitrate in the water at an elevated temperature to form an aqueous phase. This aqueous phase was added by vigorous stirring to the crosslinkable 131 MA, to which had been added the emulsifier and fuel oil until an emulsion was formed. The emulsion was allowed to cool to room temperature. Thereafter, the ammonium nitrate, polystyrene beads and triethanol amine were added with stirring. The explosive containing the emulsion cured for six (6) days.

The thus formed emulsion phase of the explosive resulted in a discontinuous oxidizing phase uniformly dispersed in a crosslinked continuous fuel phase, with the consistency of non-tacky rubber. The consistency of the explosive was firm and rubbery.

Example 5

An explosive containing a crosslinked emulsion compound was prepared by mixing the following ingredients:

| Ingredients | Percentage |
|---|---|
| Ammonium Nitrate | 51.1 |
| Calcium Nitrate | 27.4 |
| Water | 10.5 |
| Emulsifier | 1.5 |
| Diesel Oil | 3.9 |
| 131 MA | 2.4 |
| Triethanolamine | 0.2 |
| Perlite | 3.2 |

The emulsion was made in the conventional manner by dissolving the ammonium nitrate and calcium nitrate in the water at an elevated temperature to form an aqueous phase. This aqueous phase was added by vigorous stirring to the crosslinkable 131 MA, to which had been added the emulsifier and fuel oil until an emulsion was formed. The emulsion was allowed to cool to room temperature. Thereafter, the perlite and triethanol amine was added with stirring. The explosive containing the emulsion cured for two (2) days.

The thus formed emulsion resulted in a discontinuous oxidizing phase uniformly dispersed in a crosslinked continuous fuel phase, with the consistency of non-tacky rubber. The thus formed explosive had a consistency similar to that of its emulsion phase.

Example 6

An explosive containing a crosslinked emulsion compound was prepared by mixing the following ingredients:

| Ingredients | Percentage |
|---|---|
| Ammonium Nitrate | 52.2 |
| Calcium Nitrate | 28.0 |
| Water | 10.7 |
| Emulsifier | 1.5 |
| Diesel Oil | 4.0 |
| 131 MA | 2.4 |
| Triethanolamine | 0.2 |
| Polystyrene Beads | 1.0 |

The emulsion was made in the conventional manner by dissolving the ammonium nitrate and calcium nitrate in the water at an elevated temperature to form an aqueous phase. This aqueous phase was added by vigorous stirring to the crosslinkable 131 MA, to which had been added the emulsifier and fuel oil until an emulsion was formed. The emulsion was allowed to cool to room temperature. Thereafter, the triethanolamine was polystyrene beads were added with stirring. The explosive containing the emulsion cured for two (2) days.

The thus formed emulsion resulted in a discontinuous oxidizing phase uniformly dispersed in a crosslinked continuous fuel phase, with the consistency of non-tacky rubber. The explosive containing the emulsion had a consistency of non-tacky rubber.

Example 7

An explosive containing a crosslinked emulsion compound was prepared by mixing the following ingredients:

| Ingredients | Percentage |
|---|---|
| Ammonium Nitrate | 24.6 |
| Calcium Nitrate | 6.2 |
| Water | 8.4 |
| Ammonium Nitrate Prills | 53.0 |
| Emulsifier | 0.4 |
| Diesel Oil | 5.4 |
| 131 MA | 0.9 |
| Triethanolamine | 0.1 |

The emulsion was made in the conventional manner by dissolving the ammonium nitrate and calcium nitrate in the water at elevated temperature to form an aqueous phase. This aqueous phase was added by vigorous stirring to the crosslinkable 131 MA, to which had been added the emulsifier and fuel oil, until an emulsion was formed. The emulsion was allowed to cool to room temperature. Thereafter, the ammonium nitrate prills and the triethanolamine were added. The explosive containing the emulsion cured for one (1) day.

The thus formed emulsion resulted in a discontinuous oxidizing phase uniformly dispersed in a crosslinked continuous fuel phase, with the consistency of a firm substance. The explosive had a similar but firmer consistency.

Example 8

An explosive containing a polymerized emulsion compound was prepared by mixing the following ingredients:

| Ingredients | Percentage |
|---|---|
| Ammonium Nitrate | 48.7 |
| Calcium Nitrate | 30.7 |
| Water | 10.8 |
| Emulsifier | 1.0 |
| Diesel Oil | 1.0 |
| HTPB | 0.5 |
| Isonate ® 143 L | 0.1 |
| Microballoons | 2.0 |

The emulsion was made in the conventional manner by dissolving the ammonium nitrate and calcium nitrate in the water at elevated temperature to form an aqueous phase. This aqueous phase was added by vigorous stirring to the polymerizable HTPB, to which had been added the emulsifier and fuel oil until an emulsion was formed. The emulsion was allowed to cool to room temperature. Thereafter, the Isonate ® microballoons and 143 L were added. The explosive containing the emulsion cured for one (1) day.

The thus formed emulsion resulted in a discontinuous oxidizing phase uniformly dispersed in a polymerized continuous fuel phase, with the consistency of sticky rubber. The explosive had a similar consistency.

Example 9

An explosive containing a polymerized emulsion compound was prepared by mixing the following ingredients:

| Ingredients | Percentage |
|---|---|
| Ammonium Nitrate | 40.4 |
| Calcium Nitrate | 25.5 |
| Water | 7.6 |
| Ammonium Nitrate Prills | 15.0 |
| Emulsifier | 1.6 |
| Diesel Oil | 4.9 |
| HTPB | 1.6 |
| Isonate ® 143 L | 0.2 |
| Nitrite solution | 0.2 |
| H-30 Aluminum | 3.0 |

The emulsion was made in the conventional manner by dissolving the ammonium nitrate and calcium nitrate in the water at an elevated temperature to form an aqueous phase. This aqueous phase was added by vigorous stirring to the polymerizable HTPB, to which had been added the emulsifier and fuel oil until an emulsion was formed. The emulsion was allowed to cool to room temperature. Thereafter, the remaining ingredients Isonate ® 143 L was added with stirring. The explosive containing the emulsion cured for one (1) day.

The thus formed emulsion resulted in a discontinuous oxidizing phase uniformly dispersed in a polymerized continuous fuel phase, with the consistency of non-tacky rubber. The explosive was firm and rubbery.

Example 10

An explosive containing a polymerized emulsion compound was prepared by mixing the following ingredients:

| Ingredients | Percentage |
|---|---|
| Ammonium Nitrate | 12.2 |
| Calcium Nitrate | 7.7 |
| Water | 2.3 |
| Ammonium Nitrate Prills | 81.0 |
| Emulsifier | 0.2 |
| Diesel Oil | 6.1 |
| HTPB | 0.5 |
| Isonate ® 143 L | 0.1 |

The emulsion was made in the conventional manner by dissolving the ammonium nitrate and calcium nitrate in the water at an elevated temperature to form an aqueous phase. This aqueous phase was added by vigorous stirring to the polymerizable HTPB, to which had been added the emulsifier and fuel oil until an emulsion was formed. The emulsion was allowed to cool to room temperature. Thereafter, the ammonium nitrate prills and Isonate ® 143 L were added with stirring. The explosive containing the emulsion cured for twenty-one (21) days.

The thus formed emulsion resulted in a discontinuous oxidizing phase uniformly dispersed in a polymerized continuous fuel phase. The explosive had the consistency of a coherent mass of prills.

Example 11

A polymerized and crosslinked emulsion compound suitable for use in an explosive was prepared by mixing the following ingredients.

| Ingredients | Percentage |
|---|---|
| Ammonium Nitrate | 41.1 |
| Calcium Nitrate | 30.7 |
| Water | 16.4 |

-continued

| Ingredients | Percentage |
|---|---|
| Emulsifier | 1.5 |
| Diesel Oil | 7.3 |
| HTPB | 1.5 |
| 131 MA | 1.5 |

The emulsion was made in the conventional manner by dissolving the ammonium nitrate, and calcium nitrate in the water at an elevated temperature to form an aqueous phase. This aqueous phase was added by vigorous stirring to the polymerizable HTPB, to which had been added the emulsifier, and fuel oil until an emulsion was formed. The emulsion was allowed to cool to room temperature. The 131 MA was gently stirred into the emulsion. This emulsion cured for twenty-two (22) days.

The thus formed emulsion resulted in a discontinuous oxidizing phase uniformly dispersed in a polymerized and crosslinked continuous fuel phase, with the consistency of non-tacky rubber.

Example 12

A crosslinked emulsion compound suitable for use in an explosive was prepared by mixing the following ingredients:

| Ingredients | Percentage |
|---|---|
| Ammonium Nitrate | 71.1 |
| Water | 16.6 |
| Emulsifier | 1.0 |
| Diesel Oil | 10.0 |
| 131 MA | 1.0 |
| Monoethanolamine | 3.0 |

The emulsion was made in the conventional manner by dissolving the ammonium nitrate in the water at an elevated temperature to form an aqueous phase. This aqueous phase was added by vigorous stirring to the crosslinkable 131 MA, to which had been added the emulsifier, and fuel oil until an emulsion was formed. The emulsion was allowed to cool to room temperature. Thereafter, the monoethanolamine is added. This emulsion cured for eight (8) weeks.

The thus formed emulsion resulted in a discontinuous oxidizing phase uniformly dispersed in a crosslinked continuous fuel phase, with the consistency of a rubbery nontacky gel.

Example 13

A polymerized emulsion compound suitable for use in an explosive was prepared by mixing the following ingredients:

| Ingredients | Percentage |
|---|---|
| Ammonium Nitrate | 48.2 |
| Calcium Nitrate | 30.4 |
| Water | 10.3 |
| Emulsifier | 1.0 |
| Mineral Oil | 3.9 |
| HTPB | 2.9 |
| Isonate ® 143 L | 0.3 |

The emulsion was made in the conventional manner by dissolving the ammonium nitrate and calcium nitrate in the water at an elevated temperature to form an aqueous phase. This aqueous phase was added by vigorous stirring to the polymerizable HTPB, to which had been added the emulsifier, and mineral oil until an emulsion was formed. The emulsion was allowed to cool to room temperature. Thereafter, the Isonate® 143 L was added. This emulsion cured for twenty-one (21) days.

The thus formed emulsion resulted in a discontinuous oxidizing phase uniformly dispersed in a polymerized continuous fuel phase, with the consistency of nontacky rubber.

Example 14

A polymerized emulsion compound suitable for use in an explosive was prepared by mixing the following ingredients:

| Ingredients | Percentage |
|---|---|
| Ammonium Nitrate | 50.3 |
| Calcium Nitrate | 31.9 |
| Water | 9.7 |
| Emulsifier | 1.5 |
| Diesel Oil | 1.5 |
| Paraffin Wax | 4.0 |
| HTPB | 1.0 |
| Isonate ® 143 L | 0.1 |

The emulsion was made in the conventional manner by dissolving the ammonium nitrate and calcium nitrate in the water at an elevated temperature to form an aqueous phase. This aqueous phase was added by vigorous stirring to the polymerizable HTPB, to which had been added the emulsifier, diesel oil, and paraffin wax until an emulsion was formed. The emulsion was allowed to cool. Thereafter, the Isonate® 143 L was added. The explosive containing the emulsion cured for one (1) day.

The thus formed emulsion resulted in a discontinuous oxidizing phase uniformly dispersed in a polymerized continuous fuel phase with the consistency of a moldable nontacky putty;

Example 15

A polymerized emulsion compound was prepared by mixing the following ingredients:

| Ingredients | Percentage |
|---|---|
| Ammonium Nitrate | 49.1 |
| Calcium Nitrate | 31.0 |
| Water | 9.5 |
| HTPB | 5.9 |
| Isonate ® 143 L | 0.6 |

The emulsion was made in the conventional manner by dissolving the ammonium nitrate and calcium nitrate in the water at an elevated temperature to form an aqueous phase. This aqueous phase was added by vigorous stirring to the polymerizable HTPB, to which had been added the emulsifier until an emulsion was formed. The emulsion was allowed to cool. Thereafter, the Isonate® 143 L was added. The explosive containing the emulsion cured for four (4) hours.

The thus formed emulsion resulted in a discontinuous oxidizing phase uniformly dispersed in a polymerized continuous fuel phase with the consistency of a thick, stiff wax.

While the foregoing examples de facto illustrate ranges of the substituent ingredients of the emulsion or emulsion phase of an explosive containing an emulsion, ranges of substituent ingredients outside the ranges illustrated above also provide suitable emulsions or emulsion phases of explosives containing an emulsion.

Summary

It can be seen, therefore, that the present invention accomplishes each of the objects listed above. The present invention provides compositions and methods for polymerizing and/or crosslinking the continuous phase of the emulsion or the emulsion phase of an explosive containing an emulsion. This is accomplished by not only choosing polymerizable and/or crosslinkable polymers as components of the fuel phase of the emulsion, but actually polymerizing and/or crosslinking the monomers and polymers of the continuous phase to lock or hold the discontinuous phase in its dispersed position, thereby, inhibiting crystallization, coalescence, agglomeration or migration of the discontinuous oxidizing or sensitizing phase.

It will be appreciated that the advancement of the present invention provides several improvements over conventional emulsions and explosives containing an emulsion. For example, by choosing the appropriate polymerizable or crosslinkable polymer, and by polymerizing and/or crosslinking the polymer, a desired rheology of the subject emulsion may be obtained to suit the particular need of the user. Similarly, the matrix of the desired emulsion can be polymerized and/or crosslinked chemically at room temperature and the resulting emulsion is not as sensitive to changes in ambient temperature as the currently available emulsions are. Furthermore, the rate of reaction of the polymerization or crosslinking can be controlled so as to permit the selection of different rheologies of the same emulsion over a given period of time to the advantage of the manufacturing, packaging, transporting, storage, and use processes and procedures.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A water-in-oil emulsion for use in an explosive comprising:

a continuous phase comprising a blend of organic fuel materials, at least one of the fuel materials being at least partially polymerized to achieve a preselected nonrigid rheology in the range from a fluid rheology to a nonfluid, deformable rheology, at least one of the fuel materials being substantially unpolymerized, the polymerized organic fuel material comprising a butadiene-styrene homopolymer adducted with maleic anhydride; and a discontinuous phase comprising water and at least one oxygen-containing salt.

2. A water-in-oil emulsion for use in an explosive comprising:

a continuous phase comprising a blend of organic fuel materials, at least one of the fuel materials being at least partially polymerized to achieve a preselected nonrigid rheology in the range from a fluid rheology to a nonfluid, deformable rheology, at least one of the fuel materials being substantially unpolymerized, the polymerized organic fuel material comprising a polymer with epoxy functional groups; and a discontinuous phase comprising water and at least one oxygen-containing salt.

3. A water-in-oil emulsion for use in an explosive comprising:

a continuous phase comprising a blend of organic fuel materials, at least one of the fuel materials being at least partially polymerized to achieve a preselected nonrigid rheology in the range from a fluid rheology to a nonfluid, deformable rheology, at least one of the fuel materials being substantially unpolymerized, the polymerized organic fuel material comprising a polybutadiene with hydroxyl functional groups; and a discontinuous phase comprising water and at least one oxygen-containing salt.

4. A water-in-oil emulsion for use in an explosive comprising:

a continuous phase comprising a blend of organic fuel materials, at least one of the fuel materials consisting of homopolymeric units being at least partially cross-linked in situ to achieve a preselected nonrigid rheology in the range from a fluid rheology to a nonfluid, deformable rheology, at least one of the fuel materials being substantially uncross-linked, the cross-linked organic fuel material comprising butadiene homopolymer adducted with maleic anhydride and being generally soluble in the uncross-linked organic fuel material; and a discontinuous phase comprising water and at least one oxygen-containing salt.

5. A method of achieving a desired, ultimate rheology of an emulsion for use in an explosive, the method comprising the steps of:

(a) obtaining an emulsion including:

(i) a continuous phase comprising a blend of organic fuel materials, at least one of the organic fuel materials being polymerizable and able to impart a nonrigid rheology to the emulsion upon being polymerized, at least one of the organic fuel materials being substantially unpolymerized, the polymerizable material comprising polybutadiene with hydroxy functional groups and being generally soluble in the unpolymerized organic fuel material;

(ii) a discontinuous phase comprising water and at least one oxygen-containing salt; and (b) adding a polymerizing agent in sufficient amount to polymerize at least a portion of the organic fuel material until the preselected rheology is obtained.

6. A method of achieving a desired, ultimate rheology of an emulsion for use in an explosive, the method comprising the steps of:

(a) obtaining an emulsion including:

(i) a continuous phase comprising a blend of organic fuel materials, at least one of the organic fuel materials being polymerizable and able to impart a nonrigid rheology to the emulsion upon being polymerized, at least one of the organic fuel materials being substantially unpolymerized, the polymerizable material comprising polybutadiene with epoxy functional groups and being generally soluble in the unpolymerized organic fuel material;

(ii) a discontinuous phase comprising water and at least one oxygen-containing salt; and (b) adding a polymerizing agent in sufficient amount to polymerize at least a portion of the organic fuel material until the preselected rheology is obtained.

* * * * *